US005858200A

United States Patent [19]

Takahashi et al.

[11] Patent Number: 5,858,200

[45] Date of Patent: Jan. 12, 1999

[54] METHOD OF AND APPARATUS FOR MANUFACTURING METALLIC FIBER AND THE TWINE OF METALLIC FIBERS, AND METHOD OF COLORING METALLIC FIBER AND THE TWINE OF METALLIC FIBERS

[75] Inventors: Tadashi Takahashi; Yukio Aoike; Tatsuo Hirayama, all of Kuroiso, Japan

[73] Assignee: Bridgestone Metalpha Corporation, Tokyo, Japan

[21] Appl. No.: 862,702

[22] Filed: May 23, 1997

[30] Foreign Application Priority Data

| | | | |
|---|---|---|---|
| May 30, 1996 | [JP] | Japan | 8-136252 |
| Jul. 6, 1996 | [JP] | Japan | 8-195537 |
| Jul. 18, 1996 | [JP] | Japan | 8-207878 |

[51] Int. Cl.[6] ..... C30B 30/02; C25F 1/00; C25F 5/00; C25F 7/00

[52] U.S. Cl. ..... 205/687; 205/704; 205/705; 205/714; 205/717; 205/718; 205/719; 205/720; 205/721; 205/723

[58] Field of Search ..... 205/138, 687, 205/704, 705, 723, 714, 717, 718, 719, 720, 721

[56] References Cited

FOREIGN PATENT DOCUMENTS

| | | |
|---|---|---|
| 337517 | 12/1995 | European Pat. Off. . |
| B 0-337517 | 12/1995 | European Pat. Off. . |
| 53-34589 | 9/1978 | Japan . |
| A 61-137623 | 6/1986 | Japan . |
| A 2-107798 | 4/1990 | Japan . |

*Primary Examiner*—Kathryn L. Gorgos
*Assistant Examiner*—Edna Wong
*Attorney, Agent, or Firm*—Oliff & Berridge, PLC

[57] ABSTRACT

A method of manufacturing a metallic fiber in which from a convergent extended wire, which is formed by a metallic fiber and a matrix member which is formed of a metallic material and whose dissolvability is higher than the dissolvability of the metallic fiber, the matrix member is continuously dissolved and removed by an electrolytic processing in a plurality of electrolytic tanks which are arranged in the conveying direction of the convergent extended wire, wherein: the convergent extended wire is passed through electrolytes in the plurality of electrolytic tanks, which are arranged in the shape of a gentle convex arch at the vertical direction upper side which includes the conveying passage of the convergent extended wire, the convergent extended wire is passed above a plurality of feeding devices which are provided at the outer sides of the electrolytes and which are disposed in the same arch-shape so as to correspond to the electrolytic tanks, in each of the plurality of electrolytic tanks, the metallic fiber is maintained in one of a cathode reduction area and a passivation area, or alternatively, anode current is maintained at a predetermined potential which is closer to 0, and the matrix member is anode-electrolyzed. At this time, a method of manufacturing the twine of metallic fibers, further including the step of: intertwining the convergent extended member in the unit of two to four before the electrolytic processing, while the convergent extended member is formed by a forming device in a spiral shape whose diameter is larger than the diameter of a closely-intertwined twine.

8 Claims, 9 Drawing Sheets

METHOD OF AND APPARATUS FOR MANUFACTURING METALLIC FIBER AND THE TWINE OF METALLIC FIBERS, AND METHOD OF COLORING METALLIC FIBER AND THE TWINE OF METALLIC FIBERS

BACKGROUND OF THE INVENTION

1. Field of the Invention

The present invention relates to an improved method of and an improved apparatus for manufacturing a metallic fiber, which is used advantageously as a filter, an electromagnetic shielding member, an antistatic member or the like, and to a method of and an apparatus for manufacturing the twine of metallic fibers, which is used in a product such as a belt, catalyst carrier or the like. Further, the present invention relates to a metallic fiber, in particular, a steel fiber, and the twine of metallic fibers manufactured in accordance with the above-described method. Also, the present invention relates to a method of manufacturing a color stainless steel fiber in which the color of textile can be freely selected, i.e., a color stainless steel fiber in which the mix spinning with an organic fiber or an inorganic fiber is allowed and which is useful in the fields of decoration and craft.

In general, as a technology of manufacturing inexpensively a metallic fiber whose diameter is 50 $\mu$m or less, it has been widely used that a plurality of metal wires is coated by a metallic tube member or a metallic plate member, and is extended by drawing in which the metal wires are penetrated through a die and the diameters thereof decrease. Further, the plurality of extended wires is bound and coated again by the metallic tube member or the metallic plate member and extended. The diameter of metal wire is sufficiently decreased so as to form a metallic fiber. Next, a metallic coating member, i.e., a matrix member, formed by the tube member or the plate member is dissolved by acid and removed from the extended wire, i.e., convergent extended wire, which encloses the metallic fiber. The metallic fiber is thereby obtained.

In addition, in order to form a twine from the obtained metallic fiber, the metallic fibers are bound, and the plurality of bound fibers subjected to a primary twist is at first subjected to a secondary twist.

Moreover, conventionally, a stainless steel fiber which may be extra fine is mainly kneaded with a conductive cloth, a refractory cloth, a plastic or the like and is used for interior materials or industrial applications such as a filler, a filter of filtration device, or the like which improve conductivity or thermal conductivity of the cloth. Consequently, the appearance of the stainless steel fiber was not greatly demanded. The stainless steel fiber which is used for these conventional applications is manufactured by convergent extension or excision, such that the color thereof is simply silver of the stainless steel. Accordingly, the expansion of application in which the good appearance of the stainless steel is demanded is actually impeded.

2. Description of the Related Art

So far, in a case in which the matrix member of a convergent fiber material is dissolved so as to obtain a metallic fiber, a method of submerging the matrix member in a solution such as a nitric acid is known as the method of dissolving a matrix member. For example, Japanese Patent Application Laid-Open (JP-A) No. 61-137623 (a method of manufacturing a stainless fiber) discloses a method of submerging a matrix member in a thermal nitric acid solution, and then dissolving and removing the matrix member from the convergent fiber material. Also, Japanese Patent Publication (JP-B) No. 53-34589 (a method of manufacturing a stainless metallic fiber) discloses a method of submerging a convergent extended wire in a nitric acid solution so as to dissolve and remove a matrix member (an armoring material) from the convergent extended wire, and thereafter, submerging instantaneously the convergent extended wire in a mixed solution of hydrofluoric acid and nitride acid.

Because highly reactive chemicals are used, these chemically dissolving methods required dangerous operations. At the same time, there were a drawback of environmental pollution due to the generation of $NO_x$ gas and a drawback of processing waste acid. Further, it was difficult to maintain the conditions of dissolution within a predetermined range.

On the other hand, a method of dissolving a matrix member electrochemically is known.

For example, there is a method of dissolving a matrix member electrically by direct feeding. In this case, feeding to a convergent extended wire is effected by contacting a feed roll or the like.

One of the conventional examples of direct feeding method uses conventional presser rolls, and the explanatory view of the feeding method is shown in FIG. 1. As shown in FIG. 1, as a convergent extended wire 2 is bent and nipped by a feed roll 3 and presser rolls 4, which are positioned in front of and in rear of the feed roll 3, desirable contact between the convergent extended wire 2 and the feed roll 3 is achieved. FIG. 1 shows an electrolytic tank 1.

In this feeding method, when the convergent extended wire 2 passes between the presser rolls 4 and the feed roll 3, the convergent extended wire 2 is subjected to bending. Accordingly, tension generates in the convergent extended wire 2.

Tension, which is generated due to the bending by the feeding portion and which gradually increases in the traveling direction of the convergent extended wire, becomes greater than the tensile strength at break of the convergent extended wire, which gradually decreases in a stage in which the matrix member of the convergent extended wire is being electrically dissolved. As a result, there was a drawback in that the wire is broken during the electrolytic processing.

In a stage in which the matrix member of convergent extended wire is electrically dissolved, when the metallic fibers start to expose, the tensile strength at break of each of the metallic fibers becomes extremely small. Thus, reduction in the tension generated at the convergent extended wire during the traveling thereof becomes particularly important.

As means of reducing the tension generated at the convergent extended wire during the traveling thereof, FIG. 2 shows the explanatory view of a pendulum-type feeding method. As shown in FIG. 2, a structure is formed by a supporting member 5, a pendulum-type feed roll 6 which is rotatably supported by the supporting member 5, and receiving rolls 7. The feeding to a convergent extended wire 2 is effected by contacting the pendulum-type feed roll 6 with the upper portion of the convergent extended wire 2 by the weight of the feed roll 6. In this method, excessive contact pressure is not imparted at the convergent extended wire 2 and the tension generated thereat is not great. However, it is difficult to avoid the vibrations of convergent extended wire 2 at the time of passing between the feed roll 6 and the receiving rolls 7, and due to the vibrations, the pendulum-type feed roll 6 also vibrates in the vertical direction. Consequently, there was a drawback in that the contact pressure between the convergent extended wire 2 and the pendulum-type feed roll 6 varies and that stable feeding cannot be performed.

Further, FIG. 3 shows the explanatory view of a case in which a plurality of convergent extended wires are fed by one pendulum-type feed roll. In a case in which a plurality of convergent extended wires are fed by one pendulum-type feed roll 6, the tension of each of the convergent extended wires 2 is different. Accordingly, there was a drawback in that slack occurs at the convergent extended wire 2' whose tension is small such that the convergent extended wire 2' does not contact correctly the pendulum-type feed roll 6.

In this way, since there are various drawbacks in the method of electrical dissolution by direct feeding, an indirect feeding method has been considered as well.

For example, EP 0337517B1 discloses a method in which a plurality of electrolytic tanks are provided, a plurality of electrodes are disposed at the lower portion of the tanks so that a convergent extended wire pass through the electrodes, positive and negative potentials are alternately applied to the plurality of electrodes arranged in the passing direction of the convergent extended wire, so that the matrix member of the convergent extended wires is electrolytically removed by indirect feeding.

In this indirect feeding method, there was no drawback caused by the feeding portion as in the aforementioned direct feeding methods. However, the convergent extended wire alternately becomes a cathode and an anode repeatedly during the electrolytic processing, and the matrix member is not dissolved in the cathode processing. Thus, the method was inefficient, and there was a drawback in that it is difficult to control the anode electrolytic conditions under the power supply voltage.

The first aspect of the present invention solved advantageously the above drawbacks, and the object thereof is to provide a method of and an apparatus for manufacturing a metallic fiber which dissolves and removes desirably the matrix member of a convergent extended wire by an electrolytic processing which is based on a direct feeding method and which does not generate harmful gas.

Further, with regard to manufacturing of the twine of metallic fibers, in the conventional methods, the elongation of metallic fibers is small as compared to that of organic fibers. As a result, when the fibers are twined, the fibers are broken due to the friction with a guide, and the fluffiness of twine is generated. Accordingly, the appearance of twine is deteriorated, the diameter thereof is increased, and therefore, these become drawbacks when the twine is woven into a cloth. When the twine is slack, a kink occurs due to the unwinding of twine and becomes an obstacle in subsequent manufacturing. The problem of generation of kinks due to the unwinding is especially noticeable when the thread is twined singly and not twined primarily for preventing fluffiness. In this case, subsequent manufacturing may not be carried out.

The second aspect of the present invention was developed in light of the above-described conventional art, and the object thereof is to provide the twine of metallic fibers which does not have fluffiness, which is strong, and which is not unwound. Further, the object thereof is to provide means of manufacturing the twine having such characteristics by a relatively simple method.

Conventionally, except for the case in which a silver metallic luster is used, it was inappropriate that the twine is mixedly spun or mixedly woven with dyed organic fibers. Additionally, in a case in which the twine is used as a thread for winding around a fly for fishing and adjusting buoyancy, the color of silver was not proper. Moreover, a plastic may be used as a cabinet for electronic components. At this time, from the point of view of preventing the drawbacks of electromagnetic wave, metallic fibers are mixed with the plastic. However, due to the difference in colors of the two, the appearance of cabinet was poor.

On the other hand, the method of coloring the stainless steel has been proposed. For example, Japanese Patent Application Laid-Open (JP-A) No. 2-107798 discloses a method of coloring the stainless steel electrochemically by applying a pulse potential thereto.

However, in the above-disclosed coloring method, the stainless steel to be colored is a billet. When the above-described coloring method is applied to the bundle of plurality of stainless steel fibers having the diameters of 4 to 50 $\mu$m, the fibers are broken due to the friction with a guide roll or a submerge roll, and the bundle of fibers becomes fluffy. There were drawbacks of reduction in the strength of fibers, deterioration of the appearance thereof, or the like. Moreover, in a case in which it is difficult for the electrolyte to penetrate through the interior of the bundle of fibers, there was a drawback in that the irregularities in color occurs.

Accordingly, the object of the third aspect of the present invention is to provide a color stainless steel fiber whose surface is satisfactorily colored and which does not have the above-described drawbacks, and to the method of manufacturing such color stainless steel fiber.

SUMMARY OF THE INVENTION

The present invention provides, as described in claim 1, a method of manufacturing a metallic fiber in which from a convergent extended wire, which is formed by a metallic fiber and a matrix member which is formed of a metallic material and whose dissolvability is higher than the dissolvability of the metallic fiber, the matrix member is continuously dissolved and removed by an electrolytic processing in a plurality of electrolytic tanks which are arranged in the conveying direction of the convergent extended wire, wherein: the convergent extended wire is passed through electrolytes in the plurality of electrolytic tanks, which are arranged in the shape of a gentle convex arch at the vertical direction upper side which includes the conveying passage of the convergent extended wire, the convergent extended wire is passed on a plurality of feeding devices which are provided at the outer sides of the electrolytes and which are disposed in the same arch-shape so as to correspond to the electrolytic tanks, in each of the plurality of electrolytic tanks, the metallic fiber is maintained in one of a cathode reduction area and a passivation area, or alternatively, anode current is maintained at a predetermined potential which is closer to 0, and the matrix member is anode-electrolyzed.

The present invention also provides an apparatus for manufacturing a metallic fiber which includes an extended wire unwinding machine which conveys a convergent extended wire formed by a metallic fiber and a matrix member which is formed of a metallic material and whose dissolvability is higher than the dissolvability of the metallic fiber, the apparatus further including a plurality of electrolytic tanks which include counter electrodes and which are disposed in the conveying direction of the convergent extended wire, a plurality of feeding devices provided near the outer sides of the electrolytic tanks, and a convergent extended wire winding machine which winds the convergent extended wire which has been conveyed and passed through the electrolytic tanks, and the convergent extended wire is electrolyzed continuously, wherein: the plurality of electrolytic tanks and said plurality of feeding devices are arranged in the shape of a convex arch at the vertical direction upper side which includes the conveying passage of the convergent extended wire, and feeding is effected to said convergent extended wire while the convergent extended wire travels and contacts the upper portions of the plurality of feeding devices.

The present invention further provides a method of manufacturing the twine of metallic fibers according to claim 1, which method further including the step of: intertwining the convergent extended member in the unit of two to four before said electrolytic processing, while the convergent extended member is formed by a forming device in a spiral shape whose diameter is larger than the diameter of a closely-intertwined twine.

The present invention further provides a twine of metallic fibers, wherein: a plurality of convergent members, which is in the unit of two to four, which is not subjected to primary twist, and in which one of a metal and an alloy whose composition is different from the composition of a metallic fiber forms a matrix, is subjected to plastic deformation in a spiral shape, the convergent members are intertwined and formed in one direction and do not have a habit of unwinding.

The present invention still further provides a method of manufacturing a color stainless steel, wherein: a stainless steel fiber is colored by heating the stainless steel fiber in an oxided atmosphere and by forming an oxided membrane on the surface of the fiber.

DESCRIPTION OF THE PREFERRED EMBODIMENTS

Figure 1:
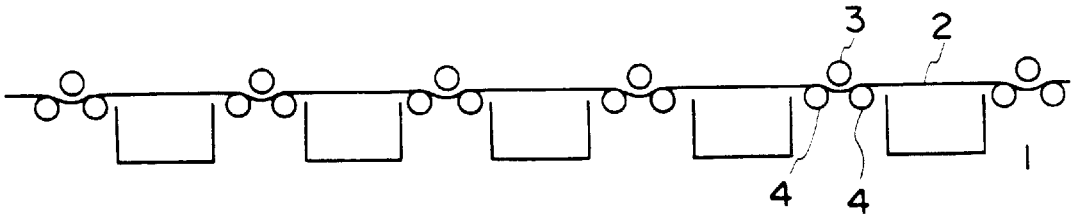
FIG. 1 (PRIOR ART)
FIG. 1 is an explanatory view of a feeding method which uses conventional presser rolls.

The operational effects and embodiments of the present invention will be described hereinafter along with test examples.

In accordance with the first aspect of the present invention, as described above, a convergent extended wire is formed by a metallic fiber and a matrix member of metallic material which is highly dissoluble compared to the metallic fiber. The matrix member is dissolved and removed from the convergent extended wire by anode electrolysis in a continuous electrolytic processing, in which a plurality of electrolytic tanks are used and feeding from the outer side of the solutions is effected, without dissolving the metallic fiber. Accordingly, the metallic fiber is obtained. In order to obtain the metallic fiber, it is necessary that the metallic fiber is held in a cathode reduction area or a passivation area, or held at a predetermined potential at which an anode current is closer to 0 for preventing dissolution of the metallic fiber, and that the matrix member is subjected to anode-electrolysis.

In the continuous electrolytic processing of such convergent extended wire by feeding from the outer side of the solution, the greatest characteristics of the present invention are to prevent breaking of the convergent extended wire, to eliminate instability of electrolytic potential, and to control the electrolytic potential easily. All of them were drawbacks.

Namely, for example, in order to decrease the tension which is generated at the convergent extended wire during an electrolytic processing and to prevent breaking of the convergent extended wire, a plurality of electrolytic tanks and a plurality of feed rolls which correspond to the tanks are disposed in a straight line in the traveling direction of the convergent extended wire. When the contact between the feed rolls and the convergent extended wire is carried out by simply moving the convergent extended wire on the feed rolls and without using presser rolls, the contact pressure is insufficient, and the stable state of contact is not obtained due to the variations in contact pressure from the vibrations of the convergent extended wire. Accordingly, the stable feeding cannot be effected.

In the present invention, a plurality of electrolytic tanks and a plurality of feed rolls corresponding thereto are disposed in the shape of an extremely gentle convex arch at the vertical direction upper side which includes the passage of convergent extended wire. While contacting the upper portions of feed rolls, the convergent extended wire passes substantially linearly within the electrolytic tanks.

In this way, the convergent extended wire contacts the feed rolls with a certain contact angle (in a case in which the feed rolls are arranged in a straight line, the contact angle is theoretically 0), and passes on the feed rolls arranged in the shape of an arch. Consequently, the tension in which the convergent extended wire is traveled acts toward the center of the arch, i.e., acts as contact force, such that the problem of lack of contact force is solved. At the same time, the vibrations of the convergent extended wire during the passing thereof are controlled, the variations in contact pressure are decreased, and the stable feeding can be carried out.

Further, even if a plurality of convergent extended wires are passed through by one feed roll, a bad contact due to the slackness of the convergent extended wire does not occur as in the case in which the aforementioned pendulum-type feeding member was used.

Regarding the aforementioned electrolytic tanks, in order to suppress the tension generated at the convergent extended wire, the convergent extended wire is passed linearly in the electrolytic tanks without providing a guide roll or the like, and the electrolyte may be overflowed.

Next, in order to dissolve only the matrix member and not dissolving the metallic fiber of the convergent extended wire, it is important that the aforementioned predetermined potential is maintained over the entire length of each of the electrolytic tanks. For achieving this, it is necessary that the length of each of the electrolytic tanks is the maximum length in which a predetermined potential can be maintained over the entire length thereof. The length of the electrolytic tank may be determined appropriately by the diameter of the convergent extended wire to be electrolytically processed or by electrical resistance.

Test examples regarding the length of the electrolytic tank will be explained hereinafter.

Figure 4A:
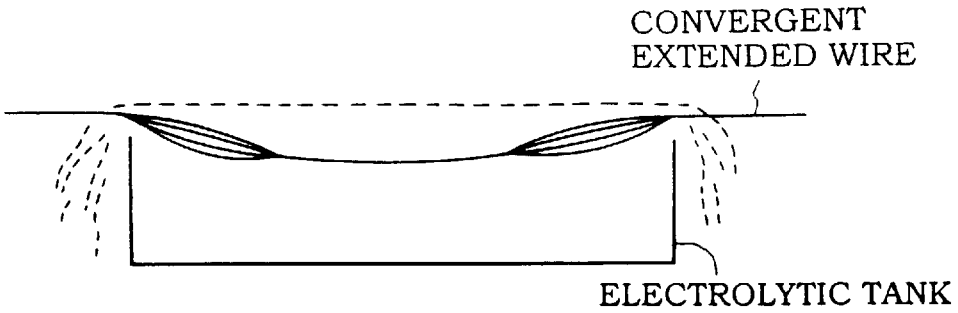
FIG. 4A is an explanatory view which shows the condition of a electrolytic processing.

The distribution of potentials in the lengthwise direction of electrolytic tank was measured when the convergent extended wire was electrolytically processed under the following conditions. The results of measurement are shown in FIGS. 4A and 4B, wherein the diameter of convergent extended wire: 0.23 mm (metallic fiber: stainless, matrix member: low carbon steel)

electrolyte: $H_2SO_4 \cdot 50$ g/l length of electrolytic tank: 50 cm feeding: feeding from both sides of the electrolytic tanks FIG. 4A is an explanatory view which shows the condition of electrolytic processing, and FIG. 4B is a graph which shows the distribution of potentials in the lengthwise direction of the electrolytic tank.

Figure 4B:
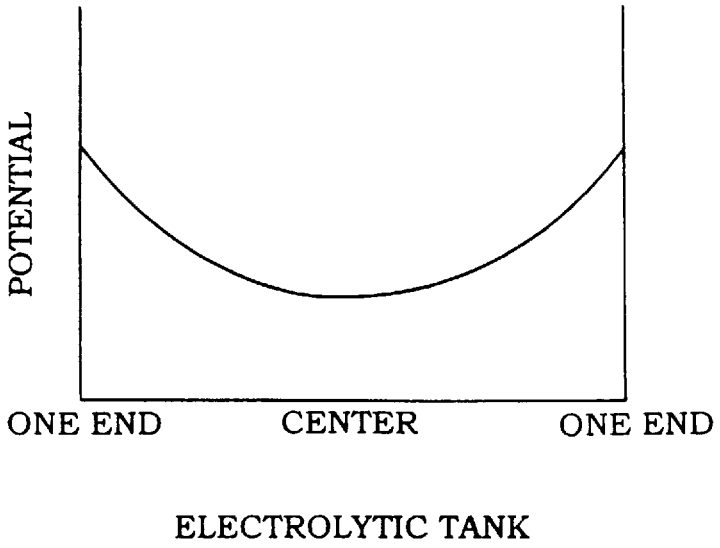
FIG. 4B is a graph which shows the distribution of potentials in the lengthwise direction of an electrolytic tank.

In FIG. 4B, because the distance from the feeding portion to the central portion of the electrolytic tank is longer and the resistivity of the convergent extended wire is relatively large, it is clear that potential of the central portion is reduced due to the increase in resistance. Consequently, it is important to determine the maximum length of the electrolytic tank.

Next, in a case in which the convergent extended wire, which has a diameter of 0.23 mm and in which 400 stainless fibers having a diameter of 8 $\mu$m are converged by a matrix member of a low carbon steel, is subjected to constant-potential electrolysis (200 mV vs SCE Saturated Calomel Electrode as reference electrode) in the electrolyte (temperature: 60° C.) of $H_2SO_4 \cdot 50$ g/l, the relationship between the time required for electrolysis to end (dissolution and removal of the matrix member is completed) and the length of the electrolytic tank was examined. The relationship is shown in the graph of FIG. 5.

Figure 5:
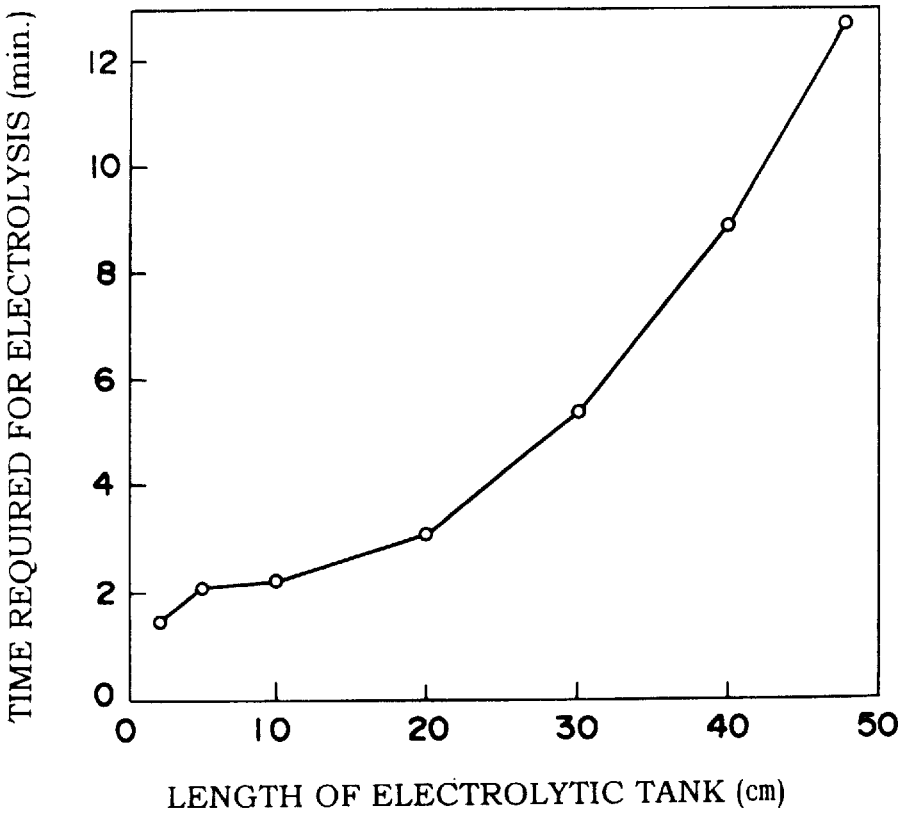
FIG. 5 is a graph which shows the relationship between the time required for electrolysis to end and the length of the electrolytic tank.

It is obvious from FIG. 5 that the effective length of the electrolytic tank is 20 cm under these conditions. If the electrolytic tank is longer than 20 cm, the time of electrolysis becomes longer. If the electrolytic tank is shorter than 20 cm, the time of electrolysis does not become so short. Therefore, from the operational and economical point of view, it is not preferable to shorten the length of electrolytic tank more than necessary.

In a case in which the plurality of electrolytic tanks are used and electrolytic processings are successively effected, the matrix member is gradually dissolved and the surface condition thereof or the like changes. Accordingly, it is essential to change a power supply voltage in each of the electrolytic tanks so as to correspond to these changes. Concretely, it is preferable to lower the power supply voltage as the electrolysis progresses.

The potential, at which the matrix member is subjected to anode electrolysis and at which the metallic fiber is not dissolved, varies in accordance with the structure and the diameter of convergent extended wire, the materials of metallic fiber and matrix member, the type of electrolyte, or the like. Accordingly, it is important to determine the potential on the basis of the convergent extended wire or the electrolyte to be used.

The control of electrolytic potential can be effected by submerging the reference electrode in the electrolyte, by measuring the potential difference between the reference electrode and the feed roll, and by adjusting the potential difference (adjusting the power supply voltage).

Moreover, as the convergent extended wire, stainless steel, titanium or titanium alloy, or nickel or nickel alloy may be used for the metallic fiber, and low carbon steel may be used for the matrix member. There are many cases in which the convergent extended wire is subjected to heat treatment during the manufacturing process. At that time, since carbon (C) of the matrix member is diffused in the metallic fiber and lowers the quality of the metallic fiber, the amount of C of the matrix member is preferably 0.12% by weight or less which is free from such degradation.

Further, sulfuric acid or mixed solution of sulfuric acid and copper sulfate may be used as the electrolyte of the convergent extended wire. By using such electrolyte, $NO_x$ gas is not generated as in the case of conventional chemical dissolving method in which nitric acid is used. Thereby, the problem of environmental pollution is solved, and in addition, the waste acid is easily processed.

Next, the device of the present invention will be explained on the basis of the drawings.

Figure 6:
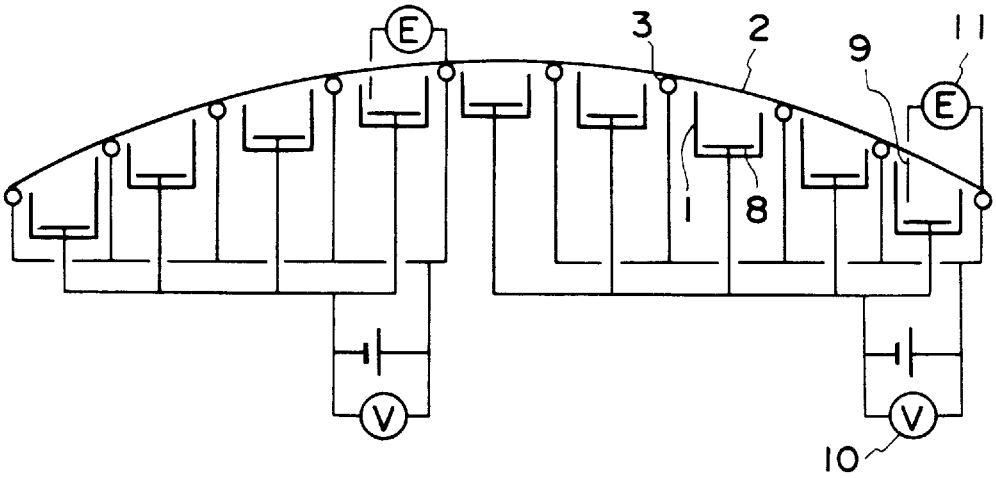
FIG. 6 is an explanatory view which shows the example of a device to which the present invention is applied and in which a plurality of electrolytic tanks and feed rolls are disposed in the shape of an arch.

FIG. 6 is an explanatory view which shows the example of a device to which the present invention is applied and in which a plurality of electrolytic tanks and feed rolls are arranged in the shape of an arch.

In FIG. 6, a plurality of electrolytic tanks 1 and a plurality of feed rolls 3 corresponding thereto are disposed in the shape of an extremely gentle convex arch in the conveying direction of the convergent extended wire 2. While the convergent extended wire 2 contacts the upper portions of the feed rolls 3, the convergent extended wire 2 travels substantially linearly in overflowing electrolytes within the electrolytic tanks 1.

An electrode (a cathode) 8 is provided at the bottom of each of the electrolytic tanks 1. A direct-current power supply 10 is connected in parallel to these electrodes 8 and the feed rolls 3 corresponding thereto. In FIG. 6, the electrodes 8 in the plurality of electrolytic tanks 1 and the feed rolls 3 are divided into a first half group and a latter half group in the conveying direction of the convergent extended wire 2, and two direct-current power supplies 10 are used to connect the respective members of the groups. In this case, one direct-current power supply 10 may be used. However, as described hereinbefore, since each of these direct-current power supplies is provided for reducing the effect of variations in an optimal power supply voltage in accordance with the progress of anode electrolysis of the convergent extended wire, the number of direct-current power supply may be increased as occasion demands.

Moreover, a potential difference between a reference electrode 9 and the feed roll 3 is measured by a potentiometer 11 such that an electrolytic potential is controlled by adjusting the measured value.

Although not shown, in order to prevent breaking of the convergent extended wire 2 and to stabilize feeding, it is extremely effective to provide a slip-type driving capstan at an entering and exiting sides of the device or at any position therebetween for adjusting the tension generated at the convergent extended wire 2.

EXAMPLE

A variety of different convergent extended wires were used. Matrix members were dissolved and removed from the convergent extended wires, and stainless steel fibers, titanium fibers, and nickel fibers were manufactured.

Example to which the present invention was applied used two sets of devices, in which 36 electrolytic tanks each having the length of 20 cm were disposed in the shape of an arch as shown in FIG. 6. A slip-type driving capstan was provided at the front and rear of each set, and the electrolytic processing of a convergent extended wire was effected in a case in which the capstans were used and in a case in which the capstans were not used. SUS was used for a reference electrode. "SUS" is an abbreviation for "Steel, Special, Stainless" and is used JIS to classify stainless steels in accordance with numbers following "SUS".

Figure 2:
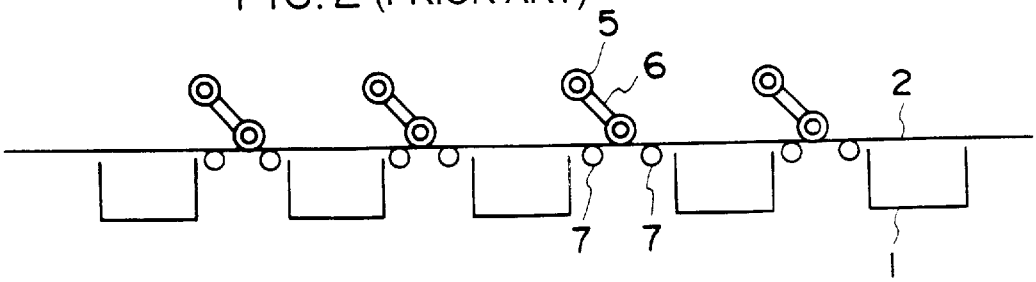
FIG. 2 (PRIOR ART)
FIG. 2 is an explanatory view of a pendulum-type feeding method.
Figure 3:
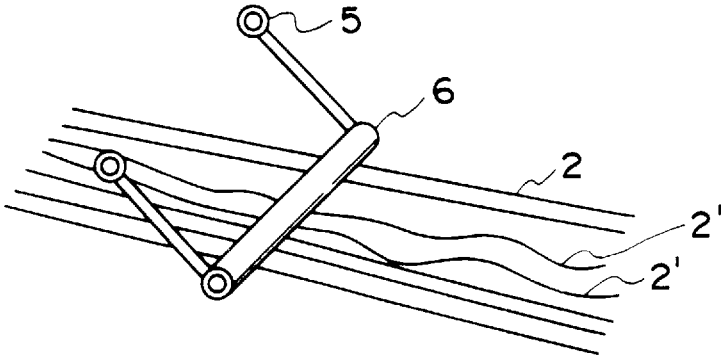
FIG. 3 (PRIOR ART)
FIG. 3 is an explanatory view of a case in which a plurality of convergent extended wires are fed by one pendulum-type feed roll.

Moreover, when a metallic fiber is manufactured by dissolving a matrix member, Conventional Example of chemical dissolving method was effected in which a convergent extended wire was submerged in a nitric acid. Additionally, Comparative Examples were carried out in which a plurality of electrolytic tanks disposed in a row on a plane surface were used and subjected to electrolytic processings, which used indirect feeding, pendulum-type feeding (FIG. 2) and feeding by using presser rolls (FIG. 1, hereinafter, the feeding will be referred to only as "presser roll type").

During these processings, the tension generated at the convergent extended wire, the breaking of wire, the processing time, the dispersion of processed states of the respective convergent extended wires, and operational environment were studied.

The ten convergent extended wires were subjected to these processings. In a case in which all of the ten wires were processed normally, it is assumed that the dispersion is small. In a case in which even one of the wires was not processed normally (the undissolved portion of the matrix member remains or the like), it is assumed that the dispersion is large. In a case in which the breaking of wire occurs, the wire cannot be processed. Thus, the dispersion of processed state cannot be studied.

Tables 1 and 2 show these processing conditions and the results of studies.

TABLE 1

| Sample No. | | 1 | 2 | 3 | 4 | 5 | 6 | 7 | 8 |
|---|---|---|---|---|---|---|---|---|---|
| Type of Electrolytic Device | | | | | | | | | |
| Feeding Method | Direct/Indirect | Direct | Direct | Direct | | In direct | Direct | Direct | Direct |
| | Feeding Electrode | Rolls in Arch-shape | Rolls in Arch-shape | Rolls in Arch-shape | | | Rolls in Arch-shape | Rolls in Arch-shape | Pendulum Type |
| Electrolytic Tank | Length (cm) | 20 | 20 | 20 | 400 (submerged) | 20 | 20 | 20 | 20 |
| | Number | 72 | 72 | 72 | 1 | 36 | 72 | 72 | 72 |
| Capstan | Yes/No | Yes | Yes | Yes | No | No | No | No | Yes |
| Convergent Extended wire | | | | | | | | | |
| Metallic Fiber | Material | SUS 316 | Ti | Ni | SUS 316 | SUS 316 | SUS 316 | SUS 316 | SUS 316 |
| | Diameter of Fiber ($\mu$m) | 8 | 18 | 30 | 8 | 8 | 10 | 12 | 8 |
| | Number of Convergence | 400 | 250 | 160 | 400 | 400 | 400 | 400 | 400 |
| Matrix | Material | Low Carbon Steel | Low Carbon Steel | Low Carbon Steel | Low Carbon Steel | Low Carbon Steel | Low Carbon Steel | Low Carbon Steel | Low Carbon Steel |
| Diameter of Convergent Extended Wire (mm) | 0.23 | 0.4 | 0.56 | 0.23 | 0.23 | 0.29 | 0,34 | 0.23 | |
| Processed Numbers | 10 | 10 | 10 | 10 | 10 | 10 | 10 | 10 | |
| Conditions of Electrolysis | | | | | | | | | |
| Electrolyte | $H_2SO_4$ (g/l) | 50 | 80 | 100 | ($HNO_3$) 200 | 50 | 50 | 50 | 50 |
| | $CUSO_4$ (g/l) | | | 45 | | | | | |
| | Temperature (°C.) | 60 | 60 | 60 | 60 | 60 | 60 | 60 | 60 |
| Potential vs SUS (mV) | | 200 to 550 | 200 to 550 | 100 | | | 200 to 550 | 200 to 550 | 200 to 550 |
| Power Supply Voltage (V) | | 0.5 to 1.5 | 0.5 to 1.5 | 0.1 to 1.1 | | 1.6 | 0.5 to 1.5 | 0.5 to 1.5 | 0.5 to 1.5 |
| Number of Power Supplies | | 10 | 10 | 10 | | 1 | 10 | 10 | 10 |

TABLE 1-continued

| Sample No. | 1 | 2 | 3 | 4 | 5 | 6 | 7 | 8 |
|---|---|---|---|---|---|---|---|---|
| Processing Time (min) | 10 | 12 | 30 | 15 | 30 | 12 | 15 | 10 |
| Tension of Wire at the Time of Electrolysis (kg) | 0.6 to 0.9 | 0.6 to 0.9 | 0.6 to 0.9 | 0.7 to 0.8 | 0.7 to 0.9 | 1.0 to 1.3 | 1.0 to 1.3 | 1.3 to 2.0 |
| Breaking of wire (Yes/No) | No | No | No | No | No | No | No | Yes |
| Dispersion of Processed State of Each Convergent Extended Wire | Small | Small | Small | Sma(1 | Small | Small | Small | |
| Operational Environment | Good | Good | Good | NOx Gene-rates | Good | Good | Good | Good |
| Remarks | Ex. | Ex. | Ex. | Conv. | Comp. | Ex. | Ex. | Com |

N.B.: "*" is the outside of the limited range of the present invention.
Ex. = Example
Comp. = Comparative Example
Conv. = Conventional Example

TABLE 2

| Sample No. | | 9 | 10 | 11 | 12 | 13 | 14 | 15 |
|---|---|---|---|---|---|---|---|---|
| Type of Electrolytic Device | | | | | | | | |
| Feeding Method | Direct/Indirect | Direct | Direct | Direct | Direct | Direct | Direct | Direct |
| Feeding | *Pendu Eiectrode | *Pendu lum Type | *Presser lum Type | *Presser Roll Type | Presser Roll Type | Rolls in Roll Type | Rolls in Arch-shape | Arch-shape |
| Electro-lytic | Length (cm) | 20 | 20 | 20 | 20 | 20 | 20 | 20 |
| Tank | Number | 72 | 72 | 72 | 72 | 72 | 72 | 72 |
| Capstan | Yes/No | Yes | Yes | Yes | Yes | Yes | Yes | Yes |
| Convergent Extended wire | | | | | | | | |
| Metallic fiber | Material | SUS 316 | SUS 316 | SUS 316 | SUS 316 | SUS 316 | SUS 316 | SUS 316 |
| | Diameter (μm) | 10 of Fiber | 15 | 8 | 12 | 15 | 8 | 8 |
| | Number of Convergence | 400 | 400 | 400 | 400 | 400 | 400 | 400 |
| Matrix | Material | Low Carbon Steei | Low Carbon Steel | Low Carbon Steel | Low Carbon Steei | Low Carbon Steei | Low Carbon Steei | Low Carbo Steei |
| Diameter of Convergent Extended Wire (mm) | 0.29 | 0.34 | 0.23 | 0.29 | 0.34 | 0.23 | 0.23 | |
| Processed Numbers | 10 | 10 | 10 | 10 | 10 | 10 | 10 | |
| Conditions of Electrolysis | | | | | | | | |
| Electro-lyte | $H_2SO_4$ (g/l) $CUSO_4$ (g/l) | 50 | 50 | 50 | 50 | 50 | 50 | 50 |
| | Temperature (°C.) | 60 | 60 | 60 | 60 | 60 | 60 | 60 |
| Potential vs SUS (mV) | | 200 to 550 | 200 to 550 | 200 to 550 | 200 to 550 | 200 to 550 | 200 | 550 |
| Power Supply Voltage (V) | | 0.5 to 1.5 | 0.5 to 1.5 | 0.5 to 1.5 | 0.5 to 1.5 | 0.t to 1.5 | 0.5 | *1.5 |
| Number of power Supplies | | 10 | 10 | 10 | 10 | 10 | 10 | 10 |
| Processing Time (min) | | 12 | 15 | 10 | 12 | 15 | 30 | Breakage Due to Dissolution |
| Tension of Wire at the Time of Electroiysis (kg) | | 1.3 to 2.0 | 1.3 to 2.0 | 3.3 to 3.6 | 3.3 to 3.6 | 3.3 to 3.6 | 0.6 to 0.9 | 0.6 to 0.9 |
| Breaking of Wire #es/ No) | | Yes | No | Yes | Yes | Yes | No | Yes |
| Dispersion of Processed State | | | Large | | | | Small | |

TABLE 2-continued

| Sample No. | 9 | 10 | 11 | 12 | 13 | 14 | 15 |
|---|---|---|---|---|---|---|---|
| of Each Convergent Extended Wire | | | | | | | |
| Operational Environment | Good | Good | Good | Good | Good | Good | Good |
| Remarks | Comp. | Comp. | Comp. | Comp. | Comp. | Ex. | Comp. |

N.B.: "*" is the outside of the limited range of the present invention.
Comp. = Comparative Example It is clear from Tables 1 and 2 that in all of Examples to which the present invention is applied, i.e., sample Nos. 1, 2, 3, 6, 7, and 14, the wires are not broken and the dispersions of processed states are small. Unlike Conventional Example of sample No. 4 in which the convergent extended wire is submerged only in the nitric acid, $NO_x$ gas is not generated, and the metallic fibers of stainless steel (sample Nos. 1, 6, 7, and 14), of Ti (titanium) (sample No. 2), and of Ni (nickel) (sample No. 3) can be obtained under the good operational environment. By using the slip-type driving capstans which are provided at the front and rear of a series of electrolytic tanks, the stainless steel fiber whose diameter is 8 μm (sample No. 1) can be manufactured. Moreover, even if the capstan is not used, the stainless steel fiber whose diameter is 10 μm (sample No. 6) can be manufactured.

Compared to these Examples, in Comparative Examples of sample Nos. 8, 9, and 10 in which a pendulum-type feeding electrode was used (the slip-type driving capstans are used for all of the samples), the stainless steel fiber whose diameter is 10 μm or less (sample Nos. 8 and 9) cannot be manufactured due to the breaking of wire. In case of the stainless fiber whose diameter is 15 μm (sample No. 10), the breaking of wire does not occur, however, the dispersion in the processed state is large and the satisfactory fiber cannot be obtained.

In Comparative Examples of sample Nos. 11, 12, and 13 in which the presser roll type feeding electrodes were used (the slip-type driving capstans are used), the tension at the time of electrolysis becomes excessively large. Even if the diameter of the wire is as large as 15 μm, the wire is broken such that the stainless steel cannot be manufactured.

Further, in sample Nos. 14 and 15, the power supply voltages are constant. In Example of sample No. 14, because the power supply voltage is set as low as 0.5 V, even if the optimum electrolytic potential is lowered in accordance with the progress of electrolytic processing, the stainless steel fiber is not melted. Accordingly, though the processing time increases, there is no breaking of the wire. Contrary to this, in Comparative Example of sample No. 15, because the power supply voltage is set as high as 1.5 V, the potential is higher than the optimum electrolytic potential which is reduced in accordance with the progress of the electrolytic processing, and the stainless steel fiber is melted. Thus, the breaking of the wire occurs.

In the above-described samples of direct feeding other than the sample Nos. 14 and 15, the power supply voltages are adjusted (reduced) in accordance with the progress of electrolytic processings so as to maintain the electrolytic voltage at an efficient value. Consequently, as compared to Example of sample No. 1 which is under the same conditions as those of sample No. 14 except for adjusting the power supply voltage, the processing time of sample No. 14 increases greatly.

Accordingly, as the electrolytic processing progresses, it is extremely effective to adjust the power supply voltage and to maintain the electrolytic voltage at an efficient value.

On the other hand, in Comparative Example of sample No. 5 in which an indirect feeding method was used, though the breaking of wire does not occur, a lot of processing time is required as mentioned above. Compared to Example sample No. 1 which is under the same conditions as those of sample No. 5 other than the feeding method, the processing time of sample No. 5 is three times as long as that of sample No. 1.

As described above, in the first aspect of the present invention, when the matrix member of the convergent extended wire is electrically dissolved so as to manufacture the metallic fiber, the plurality of electrolytic tanks and the plurality of feed rolls corresponding thereto are disposed in the shape of a convex arch at the vertical direction upper side which includes the passage of convergent extended wire. The convergent extended wires are successively passed in the electrolytes within the electrolytic tanks and passed on the feed rolls. The convergent extended wires are electrolytically processed so as to dissolve the matrix member.

According to the present invention, under the good operational condition, the breaking of wire does not occur at the time of processing, the matrix member is dissolved efficiently in a short time, and the metallic fiber can be thereby obtained. Also, the present invention is applicable to manufacturing of various types of metallic fibers and is extremely useful in the industry.

Next, the shape of a twine of metallic fibers relating to the second aspect of the present invention will be described hereinafter. If the number of fluffs of twine is less than or equal to ten per 10 cm in the longitudinal direction thereof, the strength of twine is not lowered, the appearance thereof is great, and the twine is woven smoothly. Further, the reason for limiting the number of twines is as follows. If the number of twine is less than 100 times/m, when a guide roller passes on the twine, the cross-section of the twine becomes flat and the fluffiness due to the contact with the roller increases. Accordingly, the strength of twine is reduced sharply due to the smaller number thereof. Additionally, if the number of twine exceeds 500 times/m, twine shrinkage becomes large and the weight of twine per unit of length increases. The strength of twine is thereby reduced greatly. In view of the aforementioned, particular limitations are given and characteristics are clarified.

In addition, the method of manufacturing the twine will be explained. In order to prevent the fluffiness of metallic fibers and to keep the twining habit thereof, a plurality of convergent members are intertwined before the matrix is removed. In order to remove the matrix in a short time, the convergent member has a so-called open structure formed by a spiral whose diameter is larger than that of the closely-intertwined twine.

EXAMPLE

Example of the present invention will be described in detail hereinafter.

Firstly, the metallic fibers as described above were manufactured. Namely, a matrix was formed by low carbon steel whose amount of content of carbon is 0.08% by weight, and then the convergent member, in which 1700 stainless steels (SUS316L) were embedded in the matrix, was drawn from a die. Thus, the diameter of convergent member was reduced to 0.52 mm. At this time, the diameter of stainless steel fiber was 8 μm.

In Example, the spiral diameter of two convergent members whose diameter was reduced became 1.31 to 1.33 mm, and the convergent members were intertwined over 10 mm pitches. In Comparative Example, the two convergent members whose diameter was reduced were closely intertwined over 10 mm pitches without spiral formation. The diameter of the closely intertwined convergent members in Comparative Example measured 1.01 to 1.07 mm.

Next, while the above-described intertwined convergent members in Example and Comparative Example were traveled at a constant speed, the members were stayed in a electrolytic bath, in which an acid aqueous solution serves as an electrolyte, for a certain period of time, and then the matrix was removed therefrom. Thereafter, the members were washed and dried.

In the metallic fibers of Example, the matrix which surrounds the metallic fibers was completely removed, and the occurrence of rust was not recognized in the test of rust generation. In contrast, when the metallic fibers of Comparative Example were processed under the same conditions, the removal of matrix was incomplete and the occurrence of rust was recognized. The characteristic of open structure is obviously seen in particular.

Figure 7:
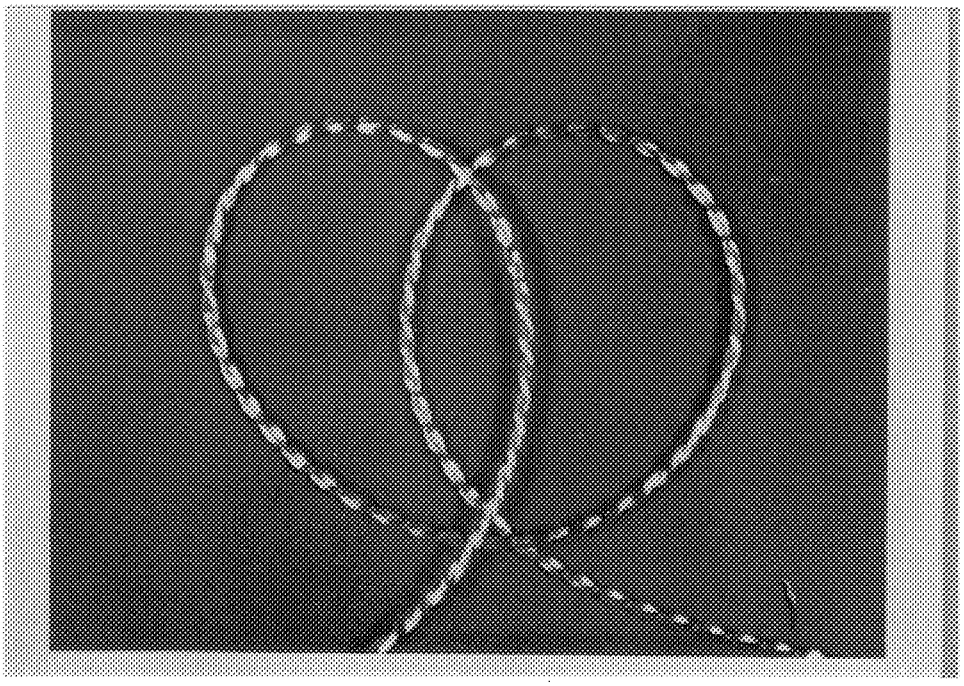
FIG. 7 is a photograph of the twine of metallic fibers relating to the present invention with a magnification of 1.2.
Figure 8:
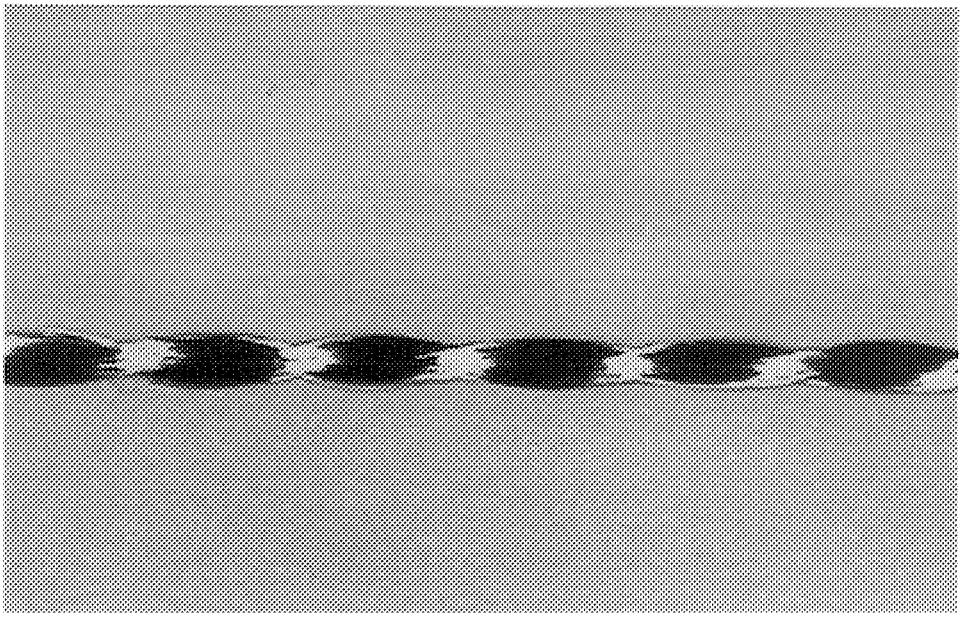
FIG. 8 is a photograph of the twine of metallic fibers relating to the present invention with a magnification of 5.

As shown in the photograph of FIG. 7 (a magnification of 1.2) and that of FIG. 8 (a magnification of 5), the twine of metallic fibers according to Example did not have fluffiness. An excellent twine which has luster peculiar to a metal and which is not untwined was obtained.

Figure 9:
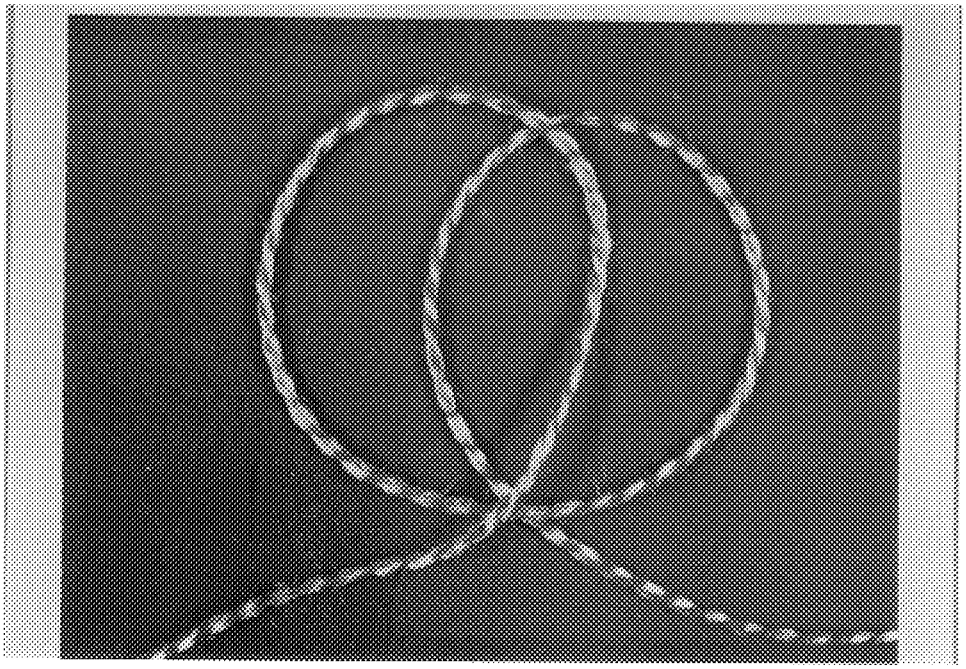
FIG. 9 (PRIOR ART)
FIG. 9 is a photograph of the twine of metallic fibers relating to a conventional example with a magnification of 1.2.
Figure 10:
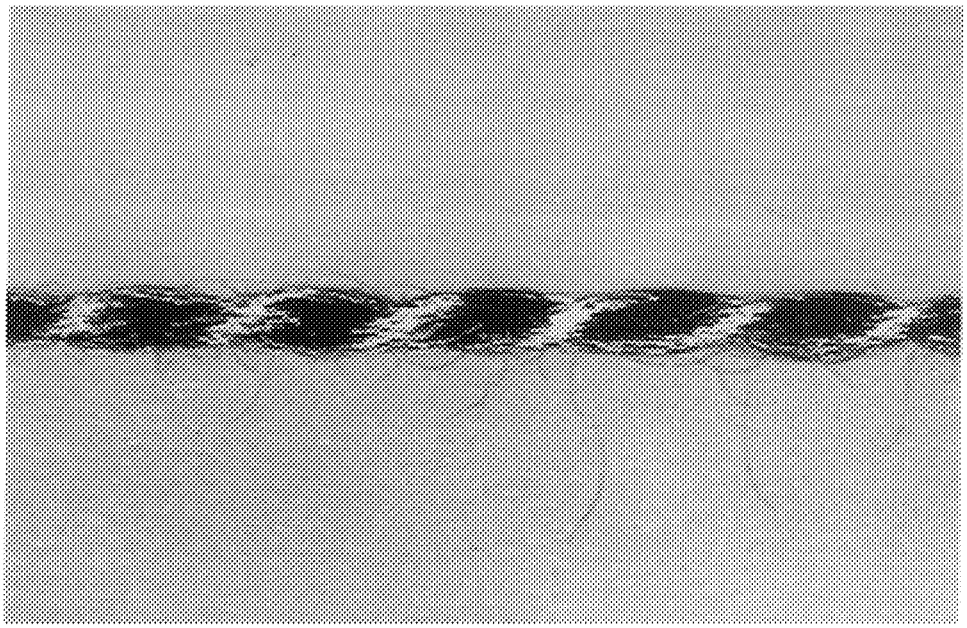
FIG. 10 (PRIOR ART)
FIG. 10 is a photograph of the twine of metallic fibers relating to the conventional example with a magnification of 5.

As shown in the photograph of FIG. 9 (a magnification of 1.2) and that of FIG. 10 (a magnification of 5), the twine according to the method of Comparative Example, in which the matrix was removed from the convergent extended members and thereafter the convergent extended members were intertwined, had fluffiness. Due to the fluffiness, metallic luster was lost. Also, the strength of twine was reduced sharply and untwinding thereof was large. Consequently, there was a drawback in operational efficiency when the twine was further manufactured to form a product.

As mentioned above, in accordance with the present invention, the twine of metallic fibers which does not have fluffiness, which is strong, and which is not untwinded are obtained and can be manufactured in simple steps. Therefore, the new application of a product which uses the twine of metallic fibers can be developed.

A color stainless steel fiber in accordance with the third aspect of the present invention is manufactured by heating the stainless steel fiber in an oxided atmosphere and generating an oxided scale on the surface of the fiber. Accordingly, it is economical since indirect materials such as a paint or a pigment are not required, and the surface of each fibers is colored uniformly.

The diameter of the color stainless steel fiber according to the third aspect of the present invention is extra fine and preferably 4 to 50 μm. In the conventional method of coloring, the color stainless steel fiber with such extra fine diameter has drawbacks in appearance, in which fibers are cut or strength thereof is reduced due to the friction with a guide roll, a submerge roll or the like.

As a material of color stainless steel fiber according to the third aspect of the present invention, it is preferable to use an austenitic stainless steel or a ferritic stainless steel, in which the diameter of a fiber can be extended up to several μm and which has less inclusions.

In the method of manufacturing the color stainless fiber, the stainless steel fiber is heated in the oxided atmosphere. Such atmosphere is oxided by gas in which oxygen is mixed with inert gas. In the atmosphere in which the oxided scale can be generated on the surface of the stainless steel fiber, the composition and density of the atmosphere should not be limited in particular. By changing the composition of atmosphere, the range of selecting the color can be increased.

Further, a heating temperature is selected in accordance with colors to be desired. The heating temperature is selected from the degree of colors and preferably from the range of 300° to 800° C. As shown concretely in the following Example, a variety of colors can be obtained within the range of such temperatures. Moreover, heating time should not be specified in particular, and may be selected properly in accordance with the heating temperature and the type of a heating furnace. The heating time is preferably about 10 to 600 seconds. When the contact time with the atmosphere is somewhat longer, the interior of the bundle of fibers can be colored more uniformly. However, in a case in which the number of convergent fibers is small, even if the contact time with the atmosphere is short, irregularities in color cannot be seen at both the interior and the exterior of the bundle of fibers. A tubular furnace, a hot air circulating furnace, or the like can be used for heating the stainless steel fibers.

In the manufacturing method of the present invention, because heating is effected in the atmosphere, the number of members, which contact the bundle of fibers, such as a guide roll can be decreased. Accordingly, fluff-mess of the bundle of fibers can be prevented.

Further, if the bundle of elongated stainless steel fibers manufactured by convergent extension is used as a material, the oxided scale can be generated continuously. Thus, the productivity of manufacturing the fibers can be improved.

Moreover, when the convergent extending method is used, the cross section of the fiber is inevitably polygon, i.e., minute convexes and concaves can be formed on the surface of the fiber. When the fiber is used as a twine or a blended yarn with an organic fiber, the coefficient of friction increases due to the convexes and concaves on the surface and entanglement may occur, such that advantageously it is difficult for the fibers to be loosened. The maximum thickness of such convexes and concaves is about 0.5 μm.

EXAMPLE

Next, the present invention will be concretely described on the basis of Example.

Figure 11:
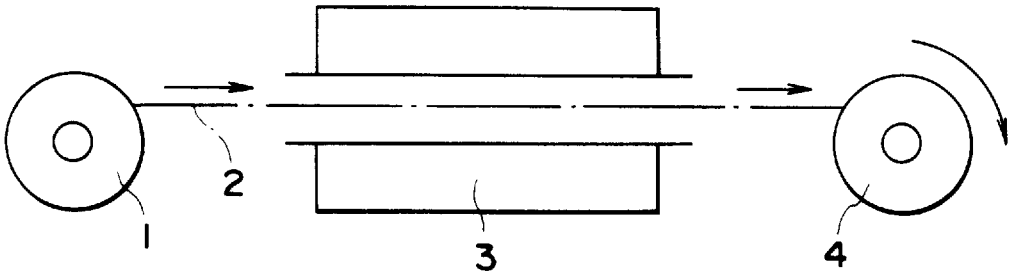
FIG. 11 is an explanatory view which shows the process of coloring a stainless steel fiber.

The diameter of a convergent member, in which a plurality of stainless steel fibers corresponding to SUS316L were embedded in a matrix, was reduced by drawing, so that the stainless steel fiber whose diameter is 20 μm was manufactured. Next, 300 stainless steel fibers were converged, and as shown in FIG. 11, a bundle of stainless steel fibers 2 was unwound from an unwinding roller 1, passed through a tubular furnace 3, and thereafter, taken up onto a take-up roller 4.

In Example, as the stainless steel fiber 2 was heated in the tubular furnace 3 continuously for about 300 seconds at the temperature of 300° C. to 800° C. under the atmosphere, the stainless steel fiber which was colored as shown in the following Table 3 was obtained.

| Heating Atmosphere | Atmosphere | | | | | |
|---|---|---|---|---|---|---|
| Heating Temperature (°C.) | 300 | 400 | 500 | 600 | 700 | 800 |
| Color | Yellow | Yellow Brown | Brown | Purple | Blue | Light Blue |

Figure 12:
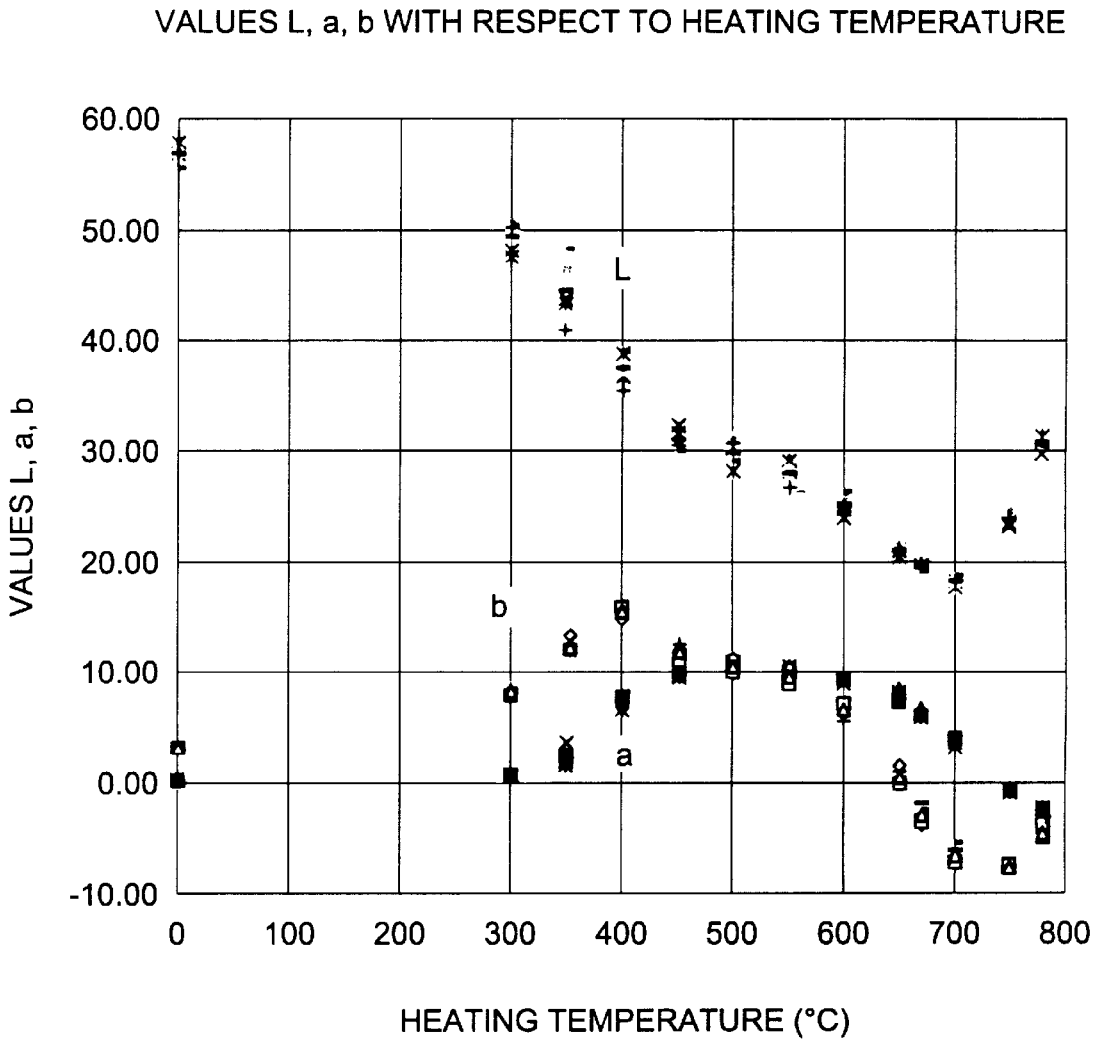
FIG. 12 is a graph which shows the relationship between L*, a*, and b* of a stainless steel fiber measured in accordance with JIS L 0804 and a heating temperature, with the L*, a*, and b* being along the axis of ordinates and the heating temperature being along the axis of abscissas.

The stainless steel fiber was heated under the atmosphere and the oxided scale was formed thereon. The color of the stainless steel fiber is shown in FIG. 12. In accordance with JIS L 0804, FIG. 12 is a graph in which L*, a*, and b* are along the axis of ordinates and the heating temperature is along the axis of abscissas. According to the graph, in a case in which heating is not effected, the value relating to lightness L* shows the brightest value. As the heating temperature goes up, the value decreases and the color of stainless steel fiber becomes darker. When the heating temperature is about 700° C. and more, the value increases again and the color of stainless steel fiber becomes brighter.

Figure 13:
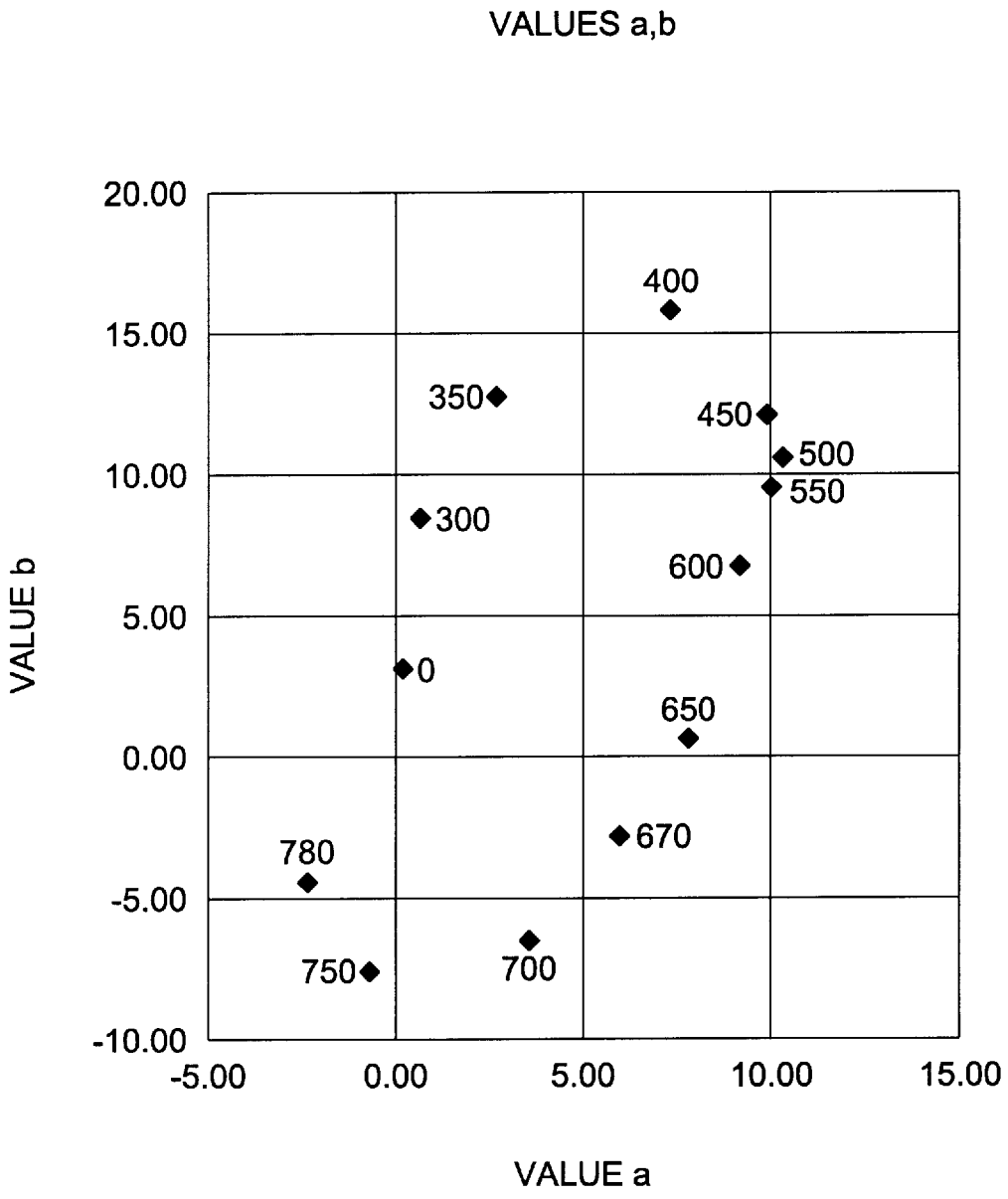
FIG. 13 is a graph which shows the results of study of the tendency of colors in accordance with the heating temperature, with the a* of the above-described stainless steel fiber being along the axis of abscissas and b* thereof being along the axis of ordinates.

Further, FIG. 13 shows the results of study of the tendency of colors in accordance with the heating temperature, with a* being along the axis of abscissas and b* being along the axis of ordinates. a* shows that the larger the numerical value, the brighter the red color. b* shows that the larger the numerical value, the brighter the yellow color. In FIG. 13, the numerical values in block letters indicate heating temperatures.

According to the graph, it is clear that the relationship between the value a* and the value b* forms a circular shape at 0° to 800° C. The colors change in accordance with the temperatures in the order of silver, yellow, yellow brown, brown, purple, blue, light blue, and silver.

Table 4 shows numerical values of data which are precisely taken from FIGS. 12 and 13. Table 4 corresponds to these drawings.

In accordance with FIGS. 12, 13 and Tables 3, 4, it is obvious that stainless steel fibers of any colors can be manufactured. Additionally, in the present embodiment, an example is given of a case in which atmosphere is used. However, by changing the composition of atmosphere, the range of selecting colors can be increased.

As described above, in the color stainless steel fiber of the present invention and the method of manufacturing the color stainless steel fiber thereof, because the stainless steel fiber is colored in a state in which conductivity, heat resistance, corrosion resistance and the like, which are the characteristics of the stainless steel fiber, are maintained, the conventional drawback of appearance in color was solved. As a result, the color stainless steel fiber of the present invention may be kneaded with a conductive cloth, a refractory cloth, a plastic or the like. The color stainless steel fiber is useful in improving the performances of various types of products for industrial applications such as a filler, a filter of filtration device, or the like which improve conductivity or thermal conductivity of the cloth, or for applications of interior materials.

Moreover, because the coloring of the stainless steel fiber is effected by forming the oxided scale, the method of the present invention has an economical advantage as well.

What is claimed is:

1. A method of manufacturing a bundle of metallic fibers from a drawn multi-fiber wire, which drawn multi-fiber wire includes a plurality of metallic fibers and a metallic matrix member having a higher dissolvability than the metallic fiber, wherein the drawn multi-fiber wire is continuously conveyed through a plurality of electrolytic baths which are arranged in series in a conveying direction of the drawn multi-fiber wire, so as to remove the matrix member by electrolytic dissolution in an electrolyte solution contained in each of the electrolytic baths, the method comprising:

providing feeding rollers between the electrolytic baths for supplying electricity and guiding the drawn multi-fiber wire through the series of the electrolytic baths, the feeding rollers being arranged in a shape of a gentle convex arch;

passing the drawn multi-fiber wire through the series of the electrolytic baths, such that the drawn multi-fiber wire contacting an upper part of each feeding roller and being immersed in the electrolyte contained in each electrolytic bath; and maintaining a supply voltage to each feeding roller within a range such that the electrolytic potential of the

TABLE 4

GRAPH DATA

| HEATING TEMPERATURE | | HEATING TEMPERATURE (°C.) HEATING TIME ABOUT 9 min. | | | | | | | | | | | | |
|---|---|---|---|---|---|---|---|---|---|---|---|---|---|---|
| | | 0 | 300 | 350 | 400 | 450 | 500 | 550 | 600 | 650 | 670 | 700 | 750 | 780 |
| VALUE a | 1 | 0.13 | 0.99 | 2.78 | 6.95 | 9.77 | 10.23 | 10.05 | 9.16 | 7.82 | 6.18 | 3.46 | −0.81 | −2.30 |
| | 2 | 0.11 | 0.85 | 2.78 | 7.88 | 9.86 | 10.30 | 9.81 | 9.34 | 7.11 | 5.89 | 4.00 | −0.59 | −2.46 |
| | 3 | 0.27 | 0.81 | 2.34 | 7.82 | 10.38 | 10.15 | 9.82 | 9.41 | 8.37 | 6.59 | 3.91 | −0.72 | −2.48 |
| | 4 | 0.27 | 0.74 | 4.02 | 7.93 | 9.64 | 10.44 | 9.96 | 8.83 | 8.08 | 5.81 | 3.17 | −0.91 | −2.21 |
| | 5 | 0.28 | 0.66 | 1.98 | 6.66 | 9.72 | 10.43 | 10.36 | 9.20 | 7.77 | 5.76 | 3.61 | −0.52 | −2.19 |
| | AV | 0.21 | 0.81 | 2.78 | 7.45 | 9.87 | 10.31 | 10.00 | 9.19 | 7.83 | 6.05 | 3.63 | −0.71 | −2.33 |
| VALUE b | 1 | 3.16 | 8.47 | 12.67 | 15.76 | 12.70 | 9.60 | 9.36 | 5.35 | 1.03 | −2.89 | −7.60 | −7.70 | −4.57 |
| | 2 | 3.06 | 8.51 | 12.24 | 15.91 | 12.15 | 10.20 | 9.46 | 6.50 | −0.51 | −2.52 | −5.46 | −7.56 | −4.90 |
| | 3 | 3.12 | 8.23 | 12.16 | 15.49 | 11.84 | 11.32 | 9.11 | 7.32 | 0.33 | −1.84 | −6.12 | −8.13 | −5.37 |
| | 4 | 2.83 | 8.31 | 13.76 | 14.93 | 12.13 | 11.23 | 10.27 | 6.08 | 1.59 | −3.86 | −6.82 | −7.51 | −4.23 |
| | 5 | 2.98 | 7.98 | 12.42 | 15.96 | 11.18 | 9.90 | 8.70 | 6.97 | −0.11 | −3.63 | −7.23 | −7.39 | −3.76 |
| | AV | 3.03 | 8.30 | 12.65 | 15.61 | 12.00 | 10.45 | 9.38 | 6.44 | 0.47 | −2.95 | −6.65 | −7.66 | −4.57 |
| VALUE LI | 1 | 56.71 | 47.99 | 43.66 | 38.67 | 32.29 | 28.19 | 28.10 | 24.13 | 20.91 | 19.54 | 17.91 | 23.03 | 29.63 |
| | 2 | 57:72 | 47.39 | 43.24 | 36.63 | 31.54 | 30.24 | 29.02 | 21.95 | 20.35 | 19.53 | 18.44 | 23.35 | 31.25 |
| | 3 | 56.83 | 50.53 | 46.24 | 37.28 | 30.64 | 30.94 | 28.17 | 25.99 | 21.21 | 19.09 | 18.40 | 24.35 | 30.71 |
| | 4 | 56.80 | 50.08 | 40.83 | 35.35 | 30.44 | 30.70 | 26.69 | 25.02 | 21.05 | 19.69 | 18.44 | 23.71 | 30.87 |
| | 5 | 55.42 | 50.24 | 48.22 | 38.85 | 29.94 | 29.09 | 27.89 | 26.46 | 20.84 | 19.00 | 18.98 | 23.66 | 30.40 |
| | AV | 56.70 | 49.25 | 44.44 | 37.36 | 30.97 | 29.83 | 27.97 | 25.31 | 20.87 | 19.37 | 18.43 | 23.62 | 30.57 |

metallic matrix is anodic, and the electrolytic potential of the metallic fibers is within one of a cathode reduction area and a passivation area, or alternatively, is closer to 0.

2. A method of manufacturing a bundle of metallic fibers according to claim 1, wherein the electrolyte overflows each electrolytic bath, and a conveying passage between consecutive feeding rollers is substantially straight.

3. A method of manufacturing a bundle of metallic fibers according to claim 2, wherein a length of the drawn multi-fiber wire immersed in the electrolyte at each electrolytic bath is a length such that a substantially uniform electrolytic potential distribution of the metallic matrix and the metallic fiber can be obtained in the electrolytic tank.

4. A method of manufacturing a bundle of metallic fibers according to claim 1, wherein the metallic fibers are comprised of a metal selected from the group consisting of stainless steel, titanium, titanium alloys nickel and nickel alloys, and said matrix member is a steel containing 0.12% or less by weight of carbon, the electrolyte is sulfuric acid or a combined solution of sulfuric acid and copper sulfate.

5. A method of manufacturing a bundle of metallic fibers from a drawn multi-fiber wire, which drawn multi-fiber wire includes a plurality of metallic fibers and a metallic matrix member having a higher dissolvability than the metallic fibers, wherein the drawn multi-fiber wire is continuously conveyed through a plurality of electrolytic baths which are arranged in series in a conveying direction of the drawn multi-fiber wire so as to remove the matrix member by electrolytic dissolution in electrolyte solution contained in each of the electrolytic baths, the method comprising:

providing feeding rollers between the electrolytic baths for supplying electricity and guiding the drawn multi-fiber wire through the series of the electrolytic baths, the feeding rollers being arranged in a shape of a gentle convex arch;

passing the drawn multi-fiber wire through the series of the electrolytic baths, such that the drawn multi-fiber wire contacting an upper part of each feeding roller and being immersed in the electrolyte contained in each electrolytic bath;

maintaining a supply voltage to each feeding roller within a range such that the electrolytic potential of the metallic matrix is anodic, and the electrolytic potential of the metallic fibers is within one of a cathode reduction area and a passivation area, or alternatively, is closer to 0; and controlling the electrolytic potentials by adjusting a potential difference between a feeding device and a reference electrode submerged in the electrolyte.

6. A method of manufacturing a bundle of metallic fibers according to claim 5, wherein the electrolyte overflows each electrolytic bath, and the conveying passage between consecutive feeding rollers is substantially straight.

7. A method of manufacturing a bundle of metallic fibers according to claim 6, wherein a length of the drawn multi-fiber wire is immersed in the electrolyte at each electrolytic bath so as to obtain a substantially uniform electrolytic potential distribution of the metallic matrix and the metallic fiber in each electrolytic bath.

8. A method of manufacturing a bundle of metallic fibers according to claim 5, wherein the metallic fibers are comprised of a metal selected from the group consisting of stainless steel, titanium, titanium alloys, nickel and nickel alloys, and the matrix member is a steel containing 0.12% or less by weight of carbon, and the electrolyte is sulfuric acid or a combined solution of sulfuric acid and copper sulfate.

* * * * *